United States Patent [19]

Sakamaki et al.

[11] Patent Number: 4,998,867

[45] Date of Patent: Mar. 12, 1991

[54] ROTARY MACHINE HAVING AXIAL PROJECTIONS ON VANES CLOSER TO OUTER EDGE

[75] Inventors: Hiroshi Sakamaki; Yukio Horikoshi; Takeshi Jinnouchi; Kenji Tanzawa, all of Sakado, Japan

[73] Assignee: Eagle Industry Co., Ltd., Tokyo, Japan

[21] Appl. No.: 394,779

[22] Filed: Aug. 16, 1989

Related U.S. Application Data

[60] Division of Ser. No. 197,548, May 23, 1988, Pat. No. 4,958,995, which is a continuation-in-part of Ser. No. 75,006, Jul. 17, 1987, abandoned, and a continuation-in-part of Ser. No. 110,919, Oct. 21, 1987, abandoned, and a continuation-in-part of Ser. No. 113,568, Oct. 26, 1987, abandoned, and a continuation-in-part of Ser. No. 115,677, Oct. 30, 1987, abandoned.

[30] Foreign Application Priority Data

| | | | |
|---|---|---|---|
| Jul. 22, 1986 | [JP] | Japan | 61-111490[U] |
| Jul. 22, 1986 | [JP] | Japan | 61-170903 |
| Oct. 23, 1986 | [JP] | Japan | 61-161609[U] |
| Oct. 23, 1986 | [JP] | Japan | 61-161610[U] |
| Nov. 4, 1986 | [JP] | Japan | 61-168145 |
| Nov. 4, 1986 | [JP] | Japan | 61-168147[U] |
| Nov. 14, 1986 | [JP] | Japan | 61-269960[U] |
| Nov. 14, 1986 | [JP] | Japan | 61-269961 |
| Nov. 17, 1986 | [JP] | Japan | 61-271934 |
| Nov. 21, 1986 | [JP] | Japan | 61-178287 |
| Nov. 21, 1986 | [JP] | Japan | 61-178288[U] |
| Nov. 21, 1986 | [JP] | Japan | 61-276689 |
| Nov. 21, 1986 | [JP] | Japan | 61-276690 |
| Dec. 3, 1986 | [JP] | Japan | 61-185571 |

[51] Int. Cl.[5] ..... F01C 1/344

[52] U.S. Cl. ..... 418/256; 418/265

[58] Field of Search ..... 418/256, 260, 261, 264, 418/265, 253

[56] References Cited

U.S. PATENT DOCUMENTS

| | | | |
|---|---|---|---|
| 599,778 | 3/1898 | Funk | 418/265 |
| 1,250,021 | 12/1917 | Rubin | 418/265 |

FOREIGN PATENT DOCUMENTS

| | | | |
|---|---|---|---|
| 354079 | 6/1922 | Fed. Rep. of Germany | 418/265 |

*Primary Examiner*—John J. Vrablik

*Attorney, Agent, or Firm*—Jordan and Hamburg

[57] ABSTRACT

A vane pump in which a projection is provided on the end of a vane which radially slides as a rotor rotates, and an annular race concentric with an inner peripheral surface of a housing is provided in the inner surface of the end wall of the housing, the projection being brought into engagement with the annular race to control the slide of the vane.

9 Claims, 5 Drawing Sheets

FIG. 4
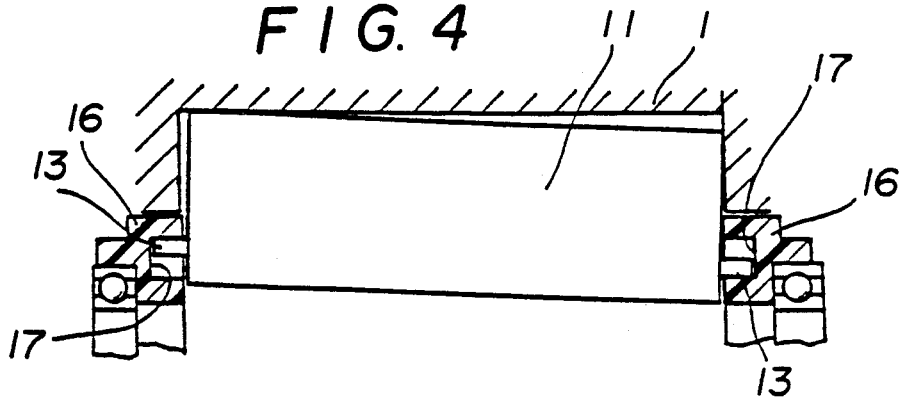
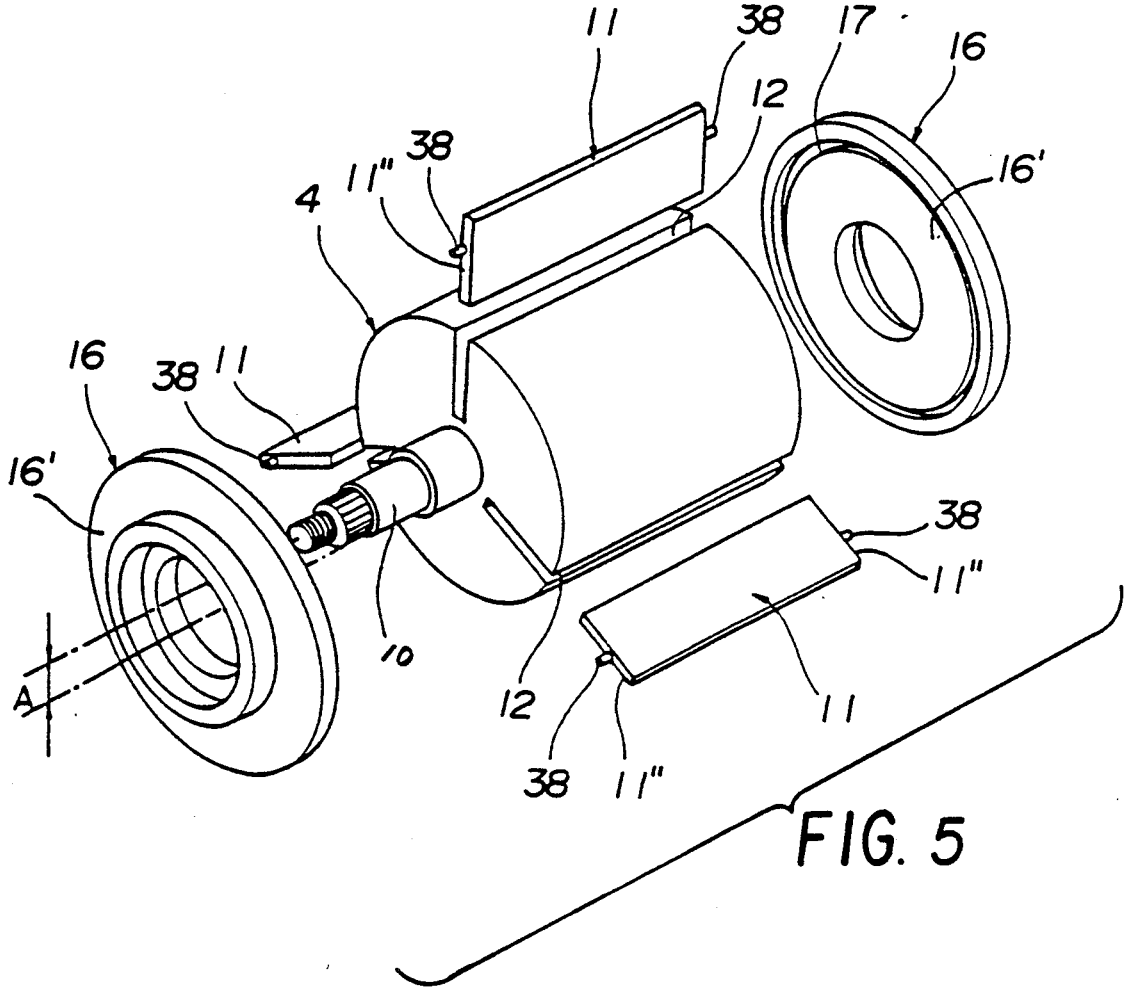
FIG. 5

ROTARY MACHINE HAVING AXIAL PROJECTIONS ON VANES CLOSER TO OUTER EDGE

RELATED APPLICATIONS

This is a division application of U.S. Ser. No. 197,548, filed May 23, 1988, U.S. Pat. No. 4,958,995, which is a continuation-in-part application of U.S. Ser. No. 075,006 filed July 17, 1987, abandoned; U.S. Ser. No. 110,919 filed Oct. 21, 1987, abandoned; U.S. Ser. No. 113,568 filed Oct. 26, 1987, abandoned; and U.S. Ser. No. 115,677 filed Oct. 30, 1987, abandoned.

BACKGROUND OF THE INVENTION

The present invention relates to a vane pump which is one of rotary pumps used for various kinds of apparatuses such as a supercharger of an engine, a compressor of a freezing cycle, and the like.

A vane pump schematically shown in FIG. 8 has been heretofore widely known.

In FIG. 8, reference numeral 101 designates a housing; 102, a rotor inserted eccentrically into an inner peripheral space of the housing 101 and rotatably supported by a rotational shaft 103; 105*a*, 105*b* and 105*c*, plate-like vanes disposed radially retractably from vane grooves 104*a*, 104*b* and 104*c* equally spaced apart so as to peripherally divide the outer peripheral side of the rotor 102 into three sections. When the rotor 102 is rotated in the direction as indicated by the arrow X by the rotational shaft 103, the vanes 105*a*, 105*b* and 105*c* are moved out in the direction of the outside diameter by the centrifugal force, and the end edges thereof rotate while slidably contacting the inner peripheral surface of the housing 101. Since the rotor 102 is eccentric with respect to the housing 101 as previously mentioned, as such rotation occurs, volumes of working spaces 106*a*, 106*b* and 106*c* defined by the housing 101, the rotor 102 and the vanes 105*a*, 105*b* and 105*c* are repeatedly enlarged and contracted to allow a fluid taken in from an intake port 107 to be discharged out of an outlet port 108.

However, the above-described conventional vane pump has problems that since the vanes slidably move along the inner peripheral surface of the housing at high speeds, the efficiency of the volume caused by the great power loss due to the sliding resistance and by the generation of high sliding heat unavoidably deteriorates; the vanes materially become worn; and the vanes are expanded due to the generation of sliding heat to produce a galling with the inner side surfaces of both end walls of the housing, and the like.

In view of these problems as noted above, it is an object of the present invention to enhance the efficiency of such a pump and enhance the durability thereof.

SUMMARY OF THE INVENTION

To achieve the aforementioned objects, a vane pump according to the present invention is characterized in that projections such as pins are provided on both ends of a vane, and an annular race in peripheral slidable engagement with the projections to define the protrusion of the vane from a vane groove is formed coaxially with the inner peripheral surface of the housing.

According to the present invention, the protrusion of the vane from the vane groove is not defined by the contact thereof with the inner peripheral surface of the housing, but it is defined in a manner such that the end edge of the vane depicts a certain locus by the engagement of the projections such as pins provided on the vane with the annular race formed on the side of the housing. The vane may be rotated in the state in which the vane is not in contact with the inner surface of the housing, and therefore, the present invention has excellent advantages which can prevent the deterioration of the efficiency of the pump caused by the sliding resistance and the wear of the vane; and which can prevent occurrence of inconvenience resulting from an increase in sliding heat.

While the present invention has been briefly outlined, the above and other objects and new features of the present invention will be fully understood from the reading of the ensuing detailed description in conjunction with embodiments shown in the accompanying drawings. It is to be noted that the drawings are exclusively used to show certain embodiments for the understanding of the present invention and are not intended to limit the scope of this invention.

BRIEF DESCRIPTION OF THE DRAWINGS

FIG. 4 is an explanatory view showing the operating state of the vane pumps shown in FIGS. 1 to 3;

FIG. 5 is an exploded perspective view of essential parts of a vane pump according to another embodiment;

DESCRIPTION OF THE PREFERRED EMBODIMENTS

A fundamental exemplification of a vane pump according to the present invention will now be described with reference to FIGS. 1 to 3.

Figure 1:
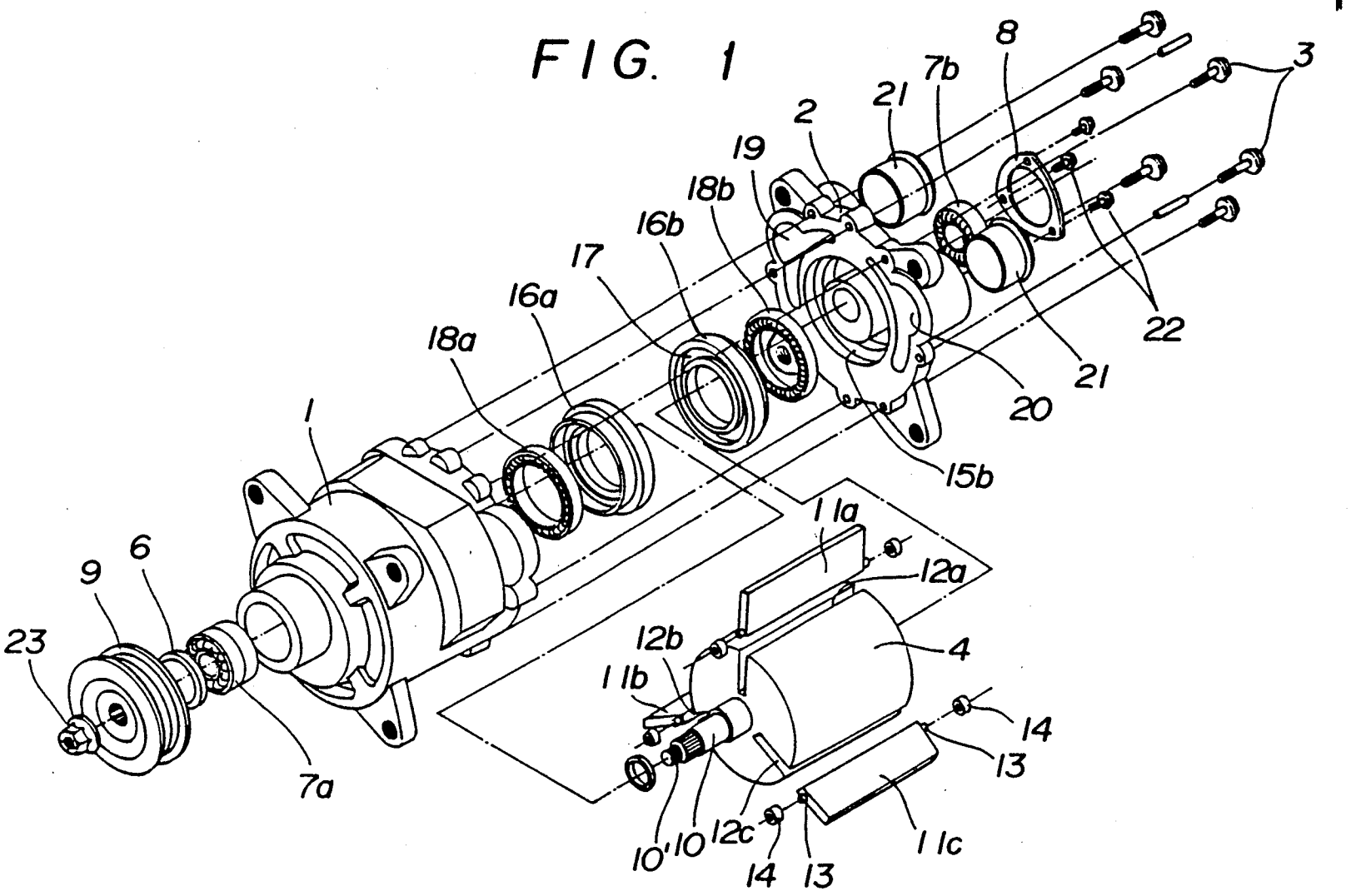
FIG. 1 is an exploded perspective view of a vane pump according to a fundamental embodiment of the present invention.
Figure 2:
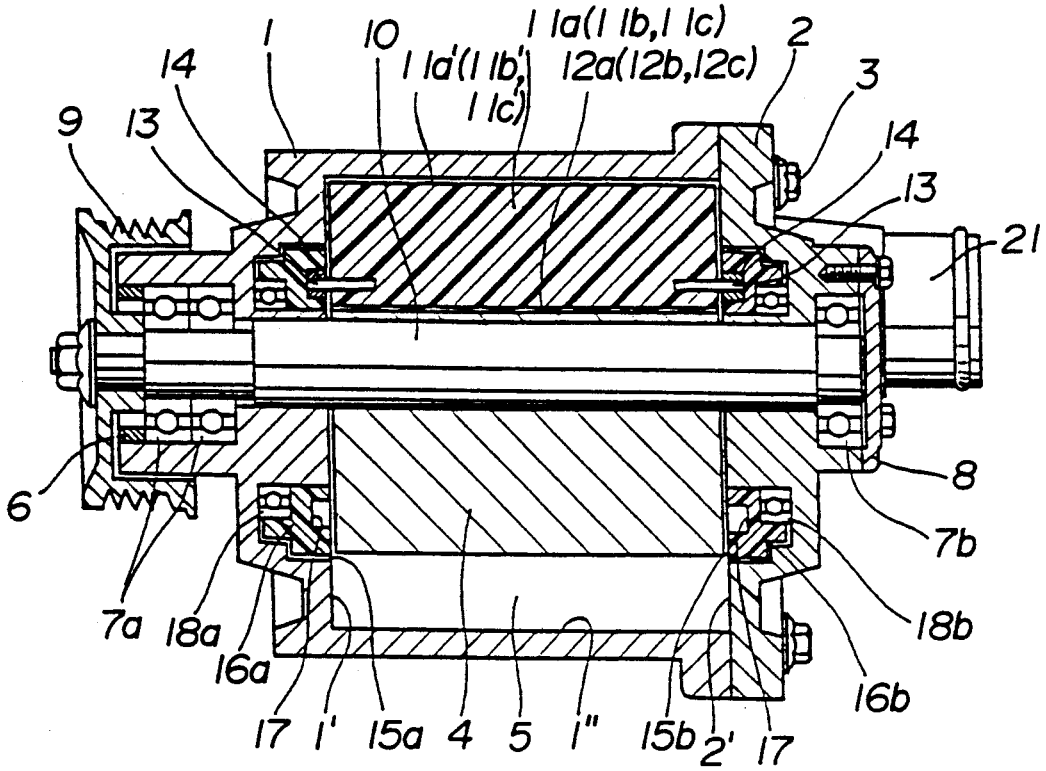
FIG. 2 is a sectional view showing the pump of FIG. 1 assembled.

In FIGS. 1 and 2, a front housing 1 and a rear housing 2, both of which housings are made of non-ferrous metal such as aluminum, which is light in weight and is small in the coefficient of thermal expansion, are secured integral with each other by means of bolts 3. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7*b* held by a bearing cover 8 in anti-slipout fashion in an axial shoulder of the rear housing 2 and is rotatably mounted on a rotational shaft 10 to which a drive force is transmitted from a pulley 9. Plate-like vanes 11*a*, 11*b* and 11*c* principally made of a carbon material having an excellent slidability are disposed to be radially projected and retracted in vane grooves 12*a*, 12*b* and 12*c*, respectively, which are formed in the form of depressions equally spaced apart so as to peripherally divide the outer peripheral side of the rotor 4 into three sections, on the rotor 4. On opposite ends of each of the vanes 11*a*, 11*b* and 11*c* corresponding to axial opposite sides of the rotor 4 are projected steel pins 13 and 13, respectively, and a sleeve bearing 14 made of resin having excellent slidability and abrasion resistance is slipped over each of pins 13. In annular recesses 15*a* and 15*b* formed in inner surfaces 1' and 2' of end walls where the front housing 1 and the rear housing 2 are opposed to each other coaxial with the inner peripheral space 5 of the housing (coaxial with the inner peripheral surface 1'' of the front housing 1), retainer rings 16*a* and 16*b* made of non-ferrous metal such as aluminum and each having an annular race 17 are rotatably fitted through ball bearings 18*a* and 18*b*, respectively. The pins 13 and 13 projected on the respective vanes 11*a*, 11*b* and 11*c* peripherally slidably engage the annular races 17 and 17 of the retainer rings 16*a* and 16*b* through the respective sleeve bearings 14. This engagement defines the radial movement of the vanes 11*a*, 11*b* and 11*c* during rotation so as to maintain a state in which there is formed a slight clearance between the end edges 11*a'*, 11*b'* and 11*c'* (see FIG. 3) thereof and the inner peripheral surface 1'' of the front housing 1. An intake port 19 for guiding a fluid into the inner peripheral space 5 of the housing from the exterior of the pump and an outlet port 20 for guiding a fluid to the exterior from the inner peripheral space 5 of the housing are formed in the rear housing 2. Reference numerals 21, 21 designate tubes mounted on the intake port 19 and outlet port 20, respectively; 22 a bolt used to secure the bearing cover 8 to the rear housing 2; and 23, a nut in engagement with an external thread 10' of the end of the rotational shaft 10 in order to secure the pulley 9 to the rotational shaft 10.

The operation of the above-described vane pump will be described hereinafter. When the rotational shaft 10 and rotor 4 are rotated by the drive force from the pulley 9, the vanes 11*a*, 11*b* and 11*c* also rotate, and the pins 13 and 13 projected on the vanes 11*a*, 11*b* and 11*c*, respectively, and the sleeve bearings 14 and 14 slipped over the pins 13 and 13 rotate along the annular races 17 and 17. Since as shown in FIG. 3, the inner peripheral surface 1'' of the housing and the annular race 17 are in coaxial relation and the annular race 17 and the rotor 4 are in eccentric relation, the vanes 11*a*, 11*b* and 11*c* are radially slidably moved in the vane grooves 12*a*, 12*b* and 12*c* of the rotor 4 to be projected and retracted repeatedly with the result that the volumes of the working spaces 5*a*, 5*b* and 5*c* defined by both the housings 1, 2, the rotor 4 and the vanes 11*a*, 11*b* and 11*c* repeatedly increase and decrease. That is, in FIG. 3, the working space 5*a*, with the rotation, increases its volume to such the fluid from the intake port 19 (not shown; see FIG. 1) opening to portion 5*a*; the working space 5*c*, with the rotation, decreases its volume to discharge the fluid into the outlet port 20 (not shown; see FIG. 1) opening to portion 5*c*; and the working space 5*b* transfers the thus sucked fluid toward the outlet port 20. In the above-described operation, the end edges 11*a'*, 11*b'* and 11*c'* of the vanes 11*a*, 11*b* and 11*c* are not in sliding contact with the inner peripheral surface 1'' of the front housing, as previously mentioned, and therefore, abrasion or high heat hardly occurs. In addition, the sleeve bearing 14 slipped over the pin 13 is slidably rotated while being pressed against the outside diameter side by the centrifugal force within the annular race 17 of the retainer rings 16*a* and 16*b* while the retainer rings 16*a* and 16*b* follow the sleeve bearing 14 for rotation because the former are in the state to be rotatable by the ball bearings 18*a* and 18*b*, respectively. The relative sliding speed between the sleeve bearing 14 and the annular race 17 is low whereby the abrasions of annular race 17, retainer rings 16*a* and 16*b*, the sleeve bearing 14 and the like can be minimized.

It is believed that the fundamental mode of the present invention is now fully understood from the above-described description. The pump of the first embodiment shown in FIGS. 1 to 3 constitutes, in a sense, the core of the variations described below.

Figure 6:
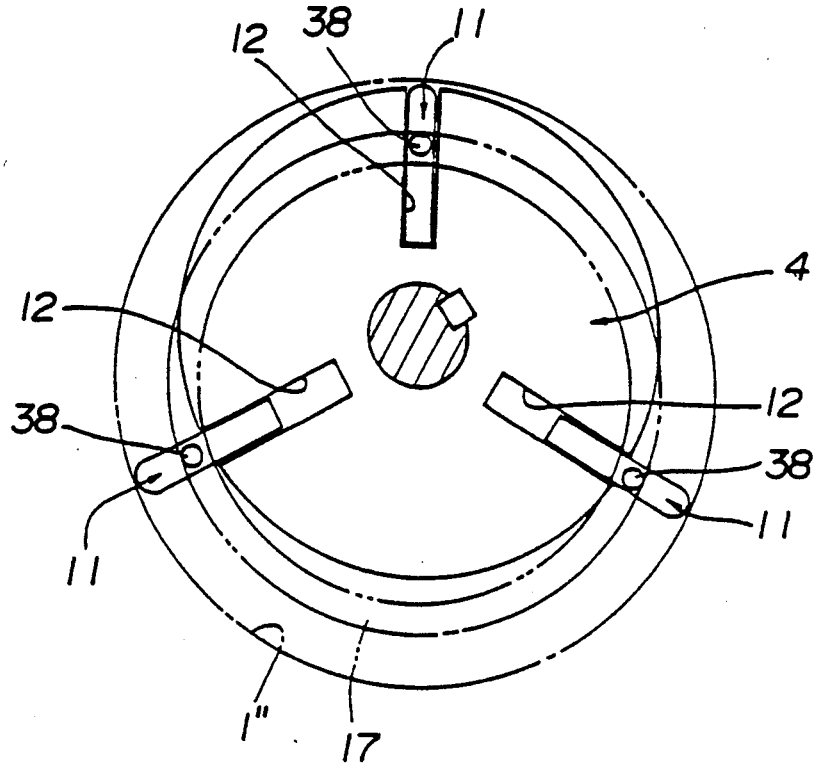
FIG. 6 is a side view of a rotor of the same pump.
Figure 7:
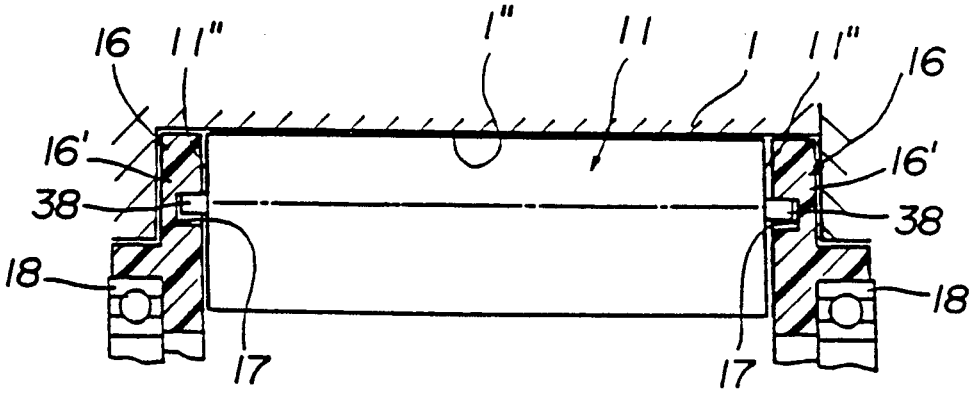
FIG. 7 is an explanatory view comparing the mounting state of the vane of the same pump with 4.
Figure 8:
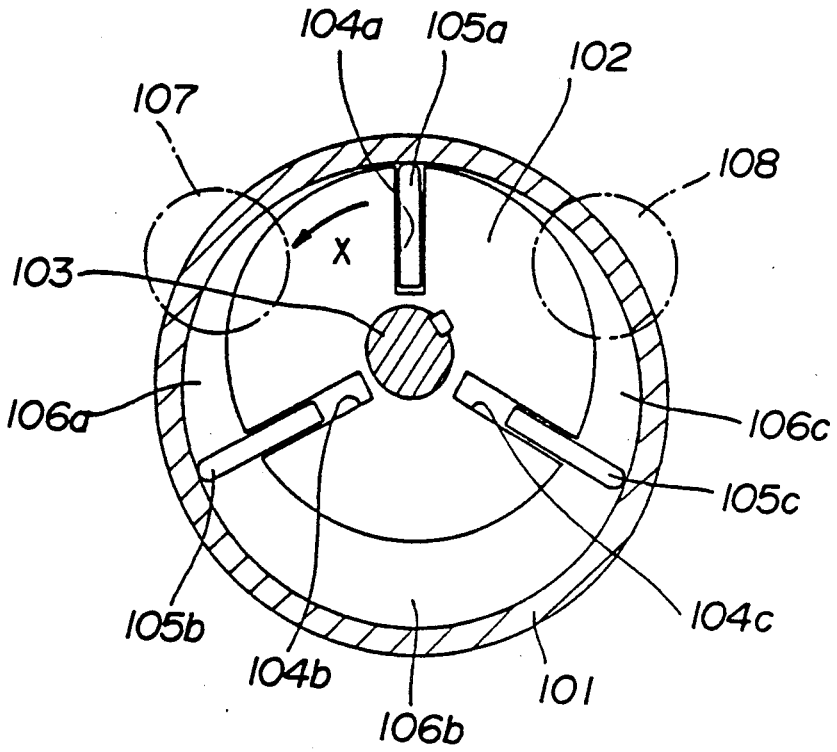
FIG. 8 PRIOR ART
FIG. 8 is a sectional view showing one example of a vane pump according to the prior art.

A vane pump belonging to the embodiment of FIGS. 5–7 is characterized in that projections are one-sided toward the inner peripheral surface of the housing rather than the lengthwise central portion between the opposite ends of the vane to form an annular race to have a larger diameter accordingly.

Figure 3:
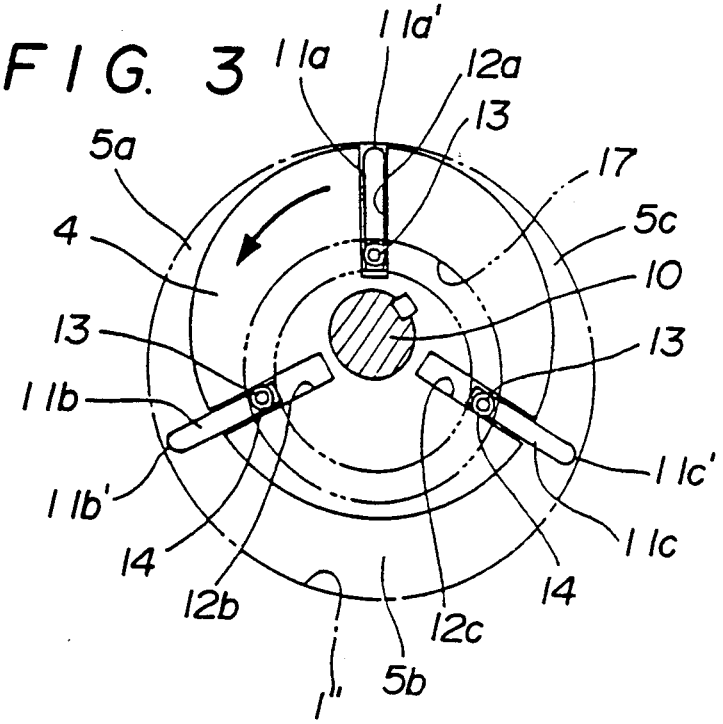
FIG. 3 is a side view of a rotor of the same pump of FIG. 1.

Also in the vane pump shown in FIGS. 1 to 3, in the case where the supporting of the vane 11 caused by the engagement between the projections 13 and the annular race 17 as shown therein is effected on the inside diameter side, an axial oscillation is derived to the vane 11 by repeated changes in pressure in the periphery of the vane 11 with pumping, to fail to perform radial parallel movement, and when the vane 11 is tilted, as shown in FIG. 4, it comes into contact with the housing 1 to produce an abnormal noise and produce galling with an opening or the like internally of the intake port 19. In addition, such contact between the vane 11 and the housing 11 entails inconveniences such as a rise in temperature, lowering of the volume efficiency, the progress of abrasion, etc. caused thereby.

In light of the foregoing, the vane pump of FIGS. 5–7 is intended to suppress the oscillation of the vane during rotation to thereby prevent an occurrence of noises and to further enhance the pump performance.

For achieving the aforesaid object, the vane pump of the type as described has a rotor rotatably supported in eccentric fashion within an inner peripheral space of a housing and vanes each disposed to be projected from and retracted in each of a plurality of vane grooves formed in the rotor, wherein projections formed on opposite ends of each of the vanes are brought into peripherally slidable engagement with annular races provided coaxially and rotatably in the inner peripheral surface of the housing internally of the housing, and wherein the projections are to be positioned one-sided toward the inner peripheral surface of the housing rather than the lengthwise central portion between the opposite ends of the vane to form the annular races to have a larger diameter correspondingly. That is, since the supporting of the vanes against the protrusion thereof is effected on the side of the outside diameter, the axial oscillation of the outside diameter portion of the vane around the projections may be suppressed to prevent it from coming into contact with the housing.

One example of the vane pump belonging to the type as described will now be described with reference to the drawings.

In FIGS. 5 to 7, projections 38 are formed on opposite ends 11'' of a vane 11 in an axial direction of a pump, the projections being positioned to be one-sided toward the inner peripheral surface of the housing 1 rather than the lengthwise central portion between the opposite ends 11'', in other words, toward the outside diameter side. Retainer rings indicated at 16 are rotatably mounted through ball bearings 18 on both inner surfaces of the housings 1 and 2 in a manner coaxial with said housings 1 and 2, that is, in the state eccentric with respect to the rotor 4 through a dimension indicated at A. An annular race 17 adapted to peripherally slidably engage the projection 38 of the vane is recessed in the end opposed to a flange 16' of each of the retainer rings 16, the annular race 17 being formed to have a large diameter corresponding to the projected position of the projection 38.

According to the above-described arrangement, the axial oscillation of the portion on the outside diameter side from the projection 38 of the vane (the portion above the phantom line in FIG. 7), around the projection 38, is suppressed, and the opposite ends 11'' of the vane in the axial direction of the pump are guided by the flanges 16' of the retainer rings 16, respectively, and therefore the contact thereof with the housings 1 and 2 will not occur.

As described above, according to the aforementioned vane pump, the projections in engagement with the annular races are provided one-sided toward the outside diameter side rather than the lengthwise central portion of the opposite ends of the vane in the radial direction of the pump to thereby suppress the axial oscillation of the vane during operation to prevent the contact thereof with the housings. The occurrence of abnormal noises, abnormal abrasion, and deterioration of volume efficiency resulting from such contact have been overcome, thus exhibiting an excellent performance for use with a supercharger, a compressor and the like for automobiles.

While we have described the preferred embodiment of the present invention, it will be obvious that various other modifications can be made without departing from the principle of the present invention. Accordingly, it is desired that all the modifications that may substantially obtain the effect of the present invention through the use of the structure substantially identical with or corresponding to the present invention are included in the scope of the present invention.

This application incorporates herein the disclosures of U.S. Ser. No. 075,006, filed July 17, 1987; U.S. Ser. No. 113,568 filed Oct. 26, 1987; and U.S. Ser. No. 115,677 filed Oct. 30, 1987.

What we claim is:

1. A rotary machine comprising a housing means having a rotor chamber, said rotor chamber having an inner peripheral surface, a rotor means rotatably mounted in said rotor chamber, said rotor means having an axis of rotation, said inner peripheral surface having a central axis which is eccentrically disposed relative to said axis of rotation of said rotor means, said rotor means having a plurality of generally radially disposed vane slots, a plurality of vane means slidably mounted in said vane slots and operable to define variable volume chambers for said fluid as said rotor means rotates and said vane means move generally radially in and out of said vane slots, said vane means having longitudinal ends, projection means projecting from said longitudinal ends, annular ring means rotatably mounted on said housing means for rotation about said central axis, an annular channel in each of said ring means coaxial with said central axis, said channels having a constant generally U-shaped cross-sectional configuration throughout their annular extent, said projection means on said vane means extending into said annular channels such that during rotation of said rotor means, the resulting centrifugal force urges said vane means radially outwardly of the respective vane slot such that said projection means engages said channels to limit the extent of outward radial movement of said vane means from its respective vane slot to preclude sliding contact between said vane means and said inner peripheral surface of said housing means, said vane means having an inner radial end and an outer radial end extending between said two longitudinal ends of said vane, said outer radial end being disposed juxtaposed to said inner peripheral surface of said housing means during operation of the rotary machine, said projection means being spaced from said outer radial end while being disposed closer to said outer radial end than to said inner radial end.

2. A rotary machine according to claim 1, wherein said projection means comprises cylindrical members having an outer cylindrical surface with a diameter less than the radial width of said channels.

3. A rotary machine according to claim 1, further comprising bearing means for rotatably supporting said ring means on said housing means.

4. A rotary machine according to claim 1, wherein said housing means has end walls which define longitudinal ends of said rotor chamber, annular recess means in said end walls, said ring means having a front side and an opposite rear side, said front side being juxtaposed to said longitudinal ends of said vane means, said rear side having an annular extended portion extending into said recess means, and bearing means in said recess means juxtaposed to said annular extended portion for rotatably supporting said ring means on said housing means.

5. A rotary machine according to claim 4, wherein said annular extended portion comprises an annular ring portion, said annular ring portion being disposed radially inwardly of said channels.

6. A rotary machine according to claim 4, wherein said ring means has a disk portion from which said annular ring portion extends, said end walls of said housing means being axially spaced from said longitudinal ends of said vane means, said disk portion being disposed in said space.

7. A rotary machine according to claim 6, wherein said recess means has a bottom recess wall formed by said housing means and extending perpendicular to said central axis, said bearing means being disposed between said bottom recess wall and said disk portion of said ring means.

8. A rotary machine according to claim 7, wherein said annular ring portion of said ring means is disposed between said bottom recess wall and said disk portion of said ring means.

9. A rotary machine comprising a housing means having a rotor chamber, said rotor chamber having an inner peripheral surface, a rotor means rotatably mounted in said rotor chamber, said rotor means having an axis of rotation, said inner peripheral surface having a central axis which is eccentrically disposed relative to said axis of rotation of said rotor means, said rotor means having a plurality of generally radially disposed vane slots, a plurality of vane means slidably mounted in said vane slots and operable to define variable volume chambers for said fluid as said rotor means rotates and said vane means move generally radially in and out of said vane slots, said vane means having longitudinal ends, projection means projecting from said longitudinal ends, annular ring means rotatably mounted on said housing means for rotation about said central axis, an annular channel in each of said ring means coaxial with said central axis, said channels having a constant generally U-shaped cross-sectional configuration throughout their annular extent, said projection means on said vane means extending into said annular channels such that during rotation of said rotor means, the resulting centrifugal force urges said vane means radially outwardly of the respective vane slot such that said projection means engages said channels to limit the extent of outward radial movement of said vane means from its respective vane slot to preclude sliding contact between said vane means and said inner peripheral surface of said housing means, said vane means having an inner radial end and an outer radial end extending between said two longitudinal ends of said vane means, said outer radial end being disposed juxtaposed to said inner peripheral surface of said housing means during operation of the rotary machine, said projection means being spaced from said outer radial end while being disposed closer to said outer radial end than to said inner radial end.

* * * * *